US008787790B2

(12) United States Patent
Kim et al.

(10) Patent No.: US 8,787,790 B2
(45) **Date of Patent: *Jul. 22, 2014**

(54) DEVELOPING APPARATUS HAVING A SPACER AND A LEAKAGE PREVENTER

(71) Applicant: Samsung Electronics Co., Ltd., Suwon-si (KR)

(72) Inventors: Hyung-jin Kim, Seoul (KR); Ji-won Moon, Anyang-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/875,521

(22) Filed: May 2, 2013

(65) Prior Publication Data

US 2013/0302063 A1 Nov. 14, 2013

Related U.S. Application Data

(63) Continuation of application No. 13/403,251, filed on Feb. 23, 2012, now Pat. No. 8,457,519, which is a continuation of application No. 12/909,052, filed on Oct. 21, 2010, now Pat. No. 8,145,093, which is a continuation of application No. 11/234,085, filed on Sep. 26, 2005, now Pat. No. 7,822,357.

(30) Foreign Application Priority Data

Dec. 14, 2004 (KR) ..... 10-2004-105557

(51) Int. Cl.
*G03G 15/08* (2006.01)
*G03G 21/18* (2006.01)

(52) U.S. Cl.
CPC ..... *G03G 21/181* (2013.01); *G03G 2215/0875* (2013.01); *G03G 2215/088* (2013.01)
USPC ..... 399/106; 399/113; 399/114

(58) Field of Classification Search
CPC ..... G03G 21/181; G03G 21/1832; G03G 2215/0875; G03G 2215/0877; G03G 2215/088; G03G 2221/1609; G03G 2221/1648
USPC ..... 399/106, 111, 113, 114
See application file for complete search history.

(56) References Cited

U.S. PATENT DOCUMENTS 7,072,603 B2 7/2006 Tsuzuki et al.
7,813,671 B2 10/2010 Nittani et al.

(Continued)

FOREIGN PATENT DOCUMENTS

JP 2001-201914 7/2001
JP 2001-227703 8/2001

(Continued)

OTHER PUBLICATIONS

Identical Translation of Suzuki et. al (JP 2001-201914) [provided also in parent casesand previously cited] provided for Applicants' convenience.*

(Continued)

*Primary Examiner* — David Gray
*Assistant Examiner* — Laura Roth
(74) *Attorney, Agent, or Firm* — Stanzione & Kim, LLP

(57) ABSTRACT

A developing apparatus includes an organic photo conductor, an OPC frame part to support the organic photo conductor, a developing roller to develop a latent image formed on the organic photo conductor by supplying a developer, a developing roller frame part to support the developing roller, a developer storing part to store the developer and provided with a supplying opening through which the developer is supplied to the developing roller, a spacer removably interposed between the OPC frame part and the developing roller frame part and spacing the OPC frame part from the developing roller frame part such that the organic photo conductor and the developing roller do not contact each other, a leakage preventer removably attached to and sealing the supplying opening, and a connecting part to connect the spacer with the leakage preventer. Thus, the spacer and the leakage preventer are capable of being removed simultaneously.

8 Claims, 5 Drawing Sheets

(56) References Cited

U.S. PATENT DOCUMENTS

| | | | | |
|---|---|---|---|---|
| 7,822,357 | B2 * | 10/2010 | Kim | 399/106 |
| 8,145,093 | B2 * | 3/2012 | Kim et al. | 399/106 |
| 8,457,519 | B2 * | 6/2013 | Kim et al. | 399/106 |
| 2003/0156855 | A1 | 8/2003 | Nittani et al. | |
| 2005/0025522 | A1 | 2/2005 | Tsuzuki et al. | |
| 2006/0245784 | A1 | 11/2006 | Tsuzuki et al. | |

FOREIGN PATENT DOCUMENTS

| | | |
|---|---|---|
| JP | 2001-350393 | 12/2001 |
| JP | 2002-006722 | 1/2002 |
| JP | 2003-5517 | 1/2003 |
| JP | 2003-195614 | 7/2003 |
| KR | 2000-6439 | 1/2000 |

OTHER PUBLICATIONS

US Office Action issued Feb. 15, 2011 in U.S. Appl. No. 12/909,052.
US Final Office Action issued Aug. 8, 2011 in U.S. Appl. No. 12/909,052.
US Office Action issued Nov. 27, 2006 in U.S. Appl. No. 11/234,085.
US Final Office Action issued May 15, 2007 in U.S. Appl. No. 11/234,085.
US Advisory Action issued Aug. 22, 2007 in U.S. Appl. No. 11/234,085.
US Office Action issued Jan. 3, 2008 in U.S. Appl. No. 11/234,085.
US Final Office Action issued Oct. 24, 2008 in U.S. Appl. No. 11/234,085.
US Office Action issued Apr. 15, 2009 in U.S. Appl. No. 11/234,085.
US Final Office Action issued Dec. 8, 2009 in U.S. Appl. No. 11/234,085.
US Advisory Action issued Mar. 10, 2010 in U.S. Appl. No. 11/234,085.
US Office Action issued May 13, 2010 in U.S. Appl. No. 11/234,085.
US Final Office Action issued Jul. 29, 2010 in U.S. Appl. No. 11/234,085.
Korean Office Action dated Mar. 31, 2006 issued in KR 2004-105557.
US Office Action issued Sep. 12, 2012 in U.S. Appl. No. 13/403,251.
Notice of Allowance issued Feb. 1, 2013 in U.S. Appl. No. 13/403,251.

* cited by examiner

DEVELOPING APPARATUS HAVING A SPACER AND A LEAKAGE PREVENTER

CROSS-REFERENCE TO RELATED APPLICATIONS

This is a continuation application of U.S. patent application Ser. No. 13/403,251, filed on Feb. 23, 2012, which is a continuation of U.S. patent application Ser. No. 12/909,052, filed on Oct. 21, 2010, now U.S. Pat. No. 8,145,093, which is a continuation of U.S. patent application Ser. No. 11/234,085, filed on Sep. 26, 2005 now U.S. Pat. No. 7,822,357, in the U.S. Patent and Trademark Office, which claims priority under 35 U.S.C. §119 (a) of Korean Patent Application No. 2004-105557, filed on Dec. 14, 2004, in the Korean Intellectual Property Office, the disclosures of which are incorporated herein by reference in their entirety.

BACKGROUND OF THE INVENTION

1. Field of the Invention

The present general inventive concept relates to a developing apparatus, and more particularly, to a developing apparatus allowing a spacer and a leakage preventer to be simultaneously removed therefrom.

2. Description of the Related Art

A developing apparatus, comprising an organic photo conductor and a developing part, is detachably mounted on a main assembly of an electrophotographic image forming device. The developing apparatus, one of principle apparatuses that configure the electrophotographic image forming device, is employed to visualize image information loaded from the main assembly of the electrophotographic image forming device by a developer.

The electrophotographic image forming device may comprise a printer, a photocopier, a facsimile, a multi-function device, etc.

The developing apparatus is an expendable apparatus removed from the main assembly of the electrophotographic image forming device in accordance with exhaustion of the developer stored therein. When the developer is exhausted, a user removes the existing developing apparatus from the main assembly of the electrophotographic image forming device, and mounts a new developing apparatus thereon.

FIG. 1 is a sectional view schematically illustrating a conventional developing apparatus. As shown in FIG. 1, the developing apparatus comprises an organic photo conductor (OPC) 12 and a developing roller 22. The organic photo conductor 12 receives light information from a laser scanning unit (LSU), not shown, and forms a latent image on a surface thereof. The developing roller 22 supplies the latent image, formed on the organic photo conductor 12, with a developer D, thereby creating a developed image.

A developer storing part 24 stores the developer D, and comprises a supplying opening 25. The developer D is supplied through the supplying opening 25 and then to the developing roller 22 by a supplying roller 26.

The supplying opening 25 is provided with a leakage preventer 40 removably attached thereto. The leakage preventer 40 seals the supplying opening 25, thereby preventing the developer D from leaking out of the developer storing part 24 until the conventional developing apparatus is mounted on the main assembly of the electrophotographic image forming device.

Meanwhile, a user should remove the leakage preventer 40 from the supplying opening 25 before the conventional developing apparatus is mounted on the main assembly of the electrophotographic image forming device. Accordingly the developer D may be supplied to the supplying roller 26 through the supplying opening 25.

An OPC frame part 10 supports the organic photo conductor 12, and a developing roller frame part 20 supports the developing roller 22. Generally, the OPC frame part 10 is rotatably combined with the developing roller frame part 20 by a hinge part 14.

In the state in which the conventional developing apparatus is mounted on the main assembly of the electrophotographic image forming device, and thereby operated, the OPC frame part 10 and the developing roller frame part 20 support the organic photo conductor 12 and the developing roller 22, respectively, according to a control of the main assembly of the electrophotographic image forming device so that the organic photo conductor 12 and the developing roller 22 may be located with a predetermined distance therebetween for the developing process.

SUMMARY OF THE INVENTION

Accordingly, the present general inventive concept provides a developing apparatus having a spacer and a leakage preventer capable of being removed therefrom simultaneously.

Additional aspects and/or advantages of the present general inventive concept will be set forth in part in the description which follows and, in part, will be obvious from the description, or may be learned by practice of the present general inventive concept.

The foregoing and/or other aspects and advantages of the present general inventive concept are achieved by providing a developing apparatus comprising an organic photo conductor, an OPC frame part to support the organic photo conductor, a developing roller to develop a latent image formed on the organic photo conductor by supplying a developer, a developing roller frame part to support the developing roller, and a developer storing part to store the developer and provided with a supplying opening through which the developer is supplied to the developing roller, the developing apparatus further comprising a spacer removably interposed between the OPC frame part and the developing roller frame part, and spacing the OPC frame part apart from the developing roller frame part such that the organic photo conductor and the developing roller do not contact each other, a leakage preventer removably attached to and sealing the supplying opening, and a connecting part to connect the spacer with the leakage preventer.

The connecting part may comprise a flexible material.

The spacer, the leakage preventer, and the connecting part may be integrally formed.

The foregoing and/or other aspects and advantages of the present general inventive concept are also achieved by providing a developing apparatus mountable within an electrophotographic printing device, comprising an organic photo conductor (OPC) frame unit, a developing roller frame unit connected to the OPC frame unit and having a portion thereof to store a developer therein, and a removable spacing and leakage prevention unit to separate the OPC frame unit and the developing roller frame unit and to seal the portion of the developing roller frame unit to prevent the developer from leaking.

The removable spacing and leakage prevention unit may comprise a spacing portion interposed between the OPC frame unit and the developing roller frame unit, a leakage prevention portion to seal the portion of the developing roller frame unit, and a connector to connect the spacing portion and the leakage prevention portion.

The removable spacing and leakage prevention unit may comprise a protruding portion externally exposed to remove the removable spacing and leakage prevention unit.

The foregoing and/or other aspects and advantages of the present general inventive concept are also achieved by providing a seal and spacer apparatus usable with a developing apparatus having a developing roller frame part having a supply opening and an organic photo conductor (OPC) frame part, the seal and spacer apparatus comprising a removable spacer disposed between the OPC frame part and the developing roller frame part to maintain a space therebetween, a removable leakage preventer disposed to cover the supply opening, and a connecting part attached at a first end to the spacer and at a second end to the leakage preventer to remove the spacer and the leakage preventer simultaneously when a force is applied thereto.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
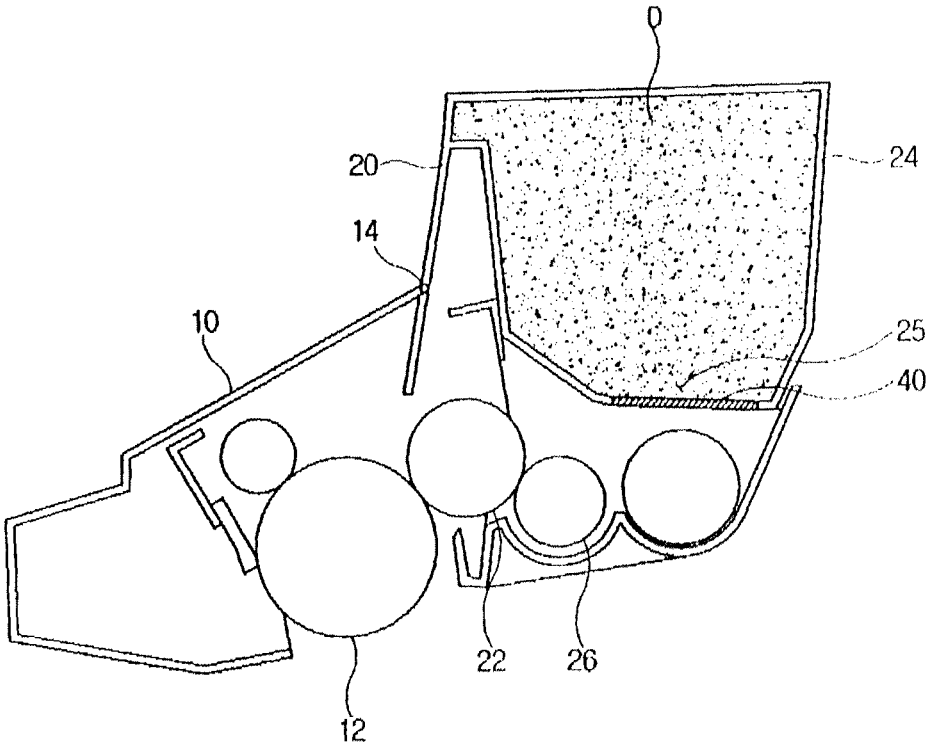
FIG. 1 (PRIOR ART)
FIG. 1 is a sectional view schematically illustrating a conventional developing apparatus.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

Figure 2:
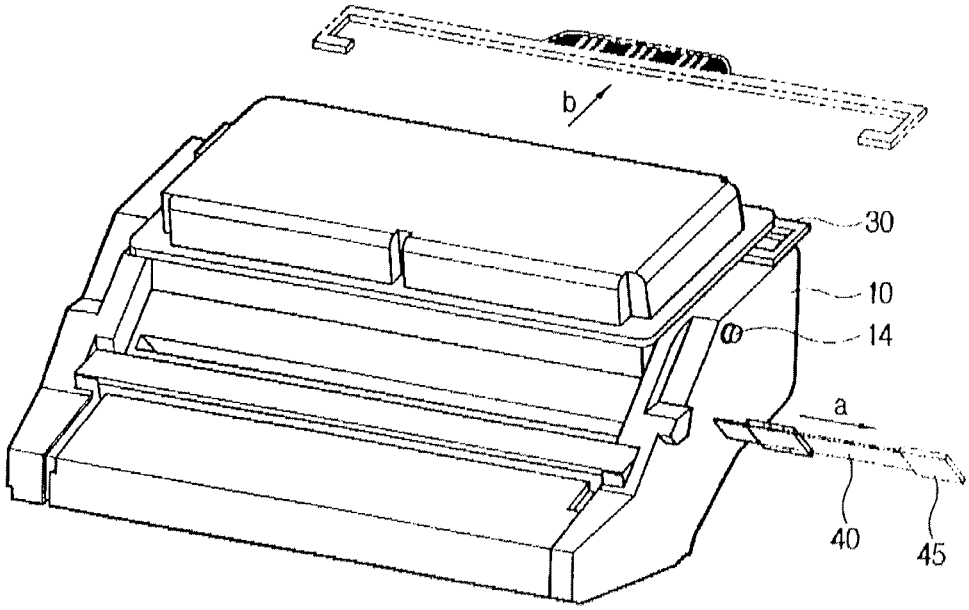
FIG. 2 is a perspective view schematically illustrating a developing apparatus.

Referring to FIG. 2, the leakage preventer 40 is provided with a handle part 45 in an end part thereof, wherein the handle part 45 is exposed externally of the developing apparatus. The user pulls the handle part 45 in the direction of arrow "a" (FIG. 2), thereby removing the leakage preventer 40 from the developing apparatus before mounting the developing apparatus on the main assembly of the electrophotographic image forming device. The leakage preventer 40 can be disposed in a leakage preventer opening that receives the leakage preventer 40 and that is removeably attached to and seals the supplying opening 25 of the developer storing part 24.

The developing apparatus of FIG. 2 comprises a spacer 30 to widen the space between the OPC frame part 10 and the developing roller frame part 20 in the state in which the developing apparatus is not yet mounted on the main assembly of the electrophotographic image forming device. Since a surface of the organic photo conductor 12 is made of a sensitive material, even the slightest collision may cause damage thereto. The spacer 30 prevents the organic photo conductor 12 and the developing roller 22 from contacting each other until the developing apparatus is mounted on the main assembly of the electrophotographic image forming device. The spacer 30 is interposed between the OPC frame part 10 and the developing roller frame part 20, and makes a sufficient space therebetween so that the organic photo conductor 12 and the developing roller 22 do not contact each other. The spacer 30 may be inserted and/or removed from an insertion opening that is defined by at least a portion of the OPC frame part 10 and at least a portion of the developing roller frame part 20. As illustrated in FIG. 2, the insertion opening can include a first insertion opening and a second insertion opening located at opposite sides of the developing apparatus.

The spacer 30 can be removed from the developing apparatus before the developing apparatus is mounted on the main assembly of the electrophotographic image forming device, or after the mounting of the developing apparatus. The user pulls the spacer 30 in the direction of arrow "b" (FIG. 2), thereby removing the spacer 30 from the developing apparatus.

The user should remove both the spacer 30 and the leakage preventer 40 from the developing apparatus before using the developing apparatus.

Further, when the spacer 30 and the leakage preventer 40 are removed from the developing apparatus, the developing apparatus may be mounted on the main assembly of the electrophotographic image forming device such that it may be used.

Figure 3:
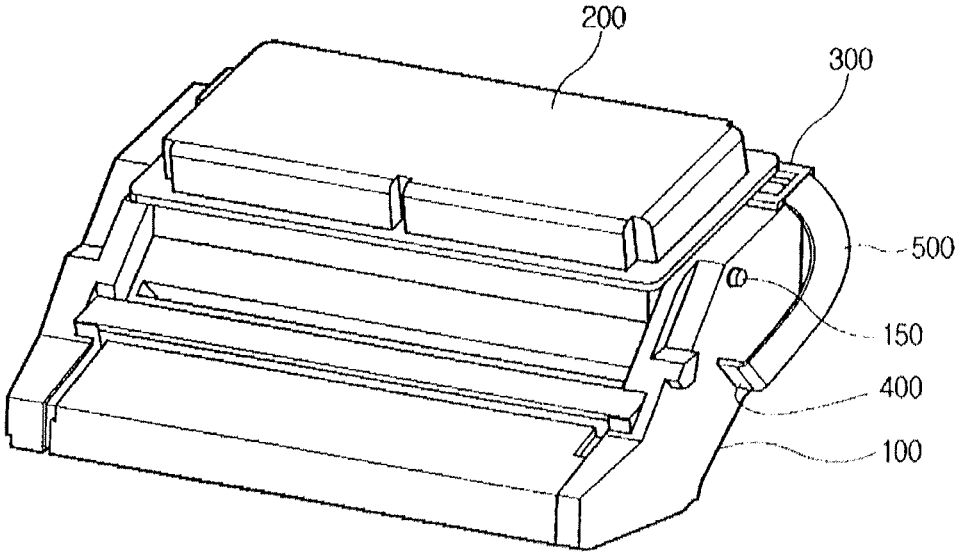
FIG. 3 is a perspective view illustrating a developing apparatus according to an embodiment of the present general inventive concept.
Figure 4:
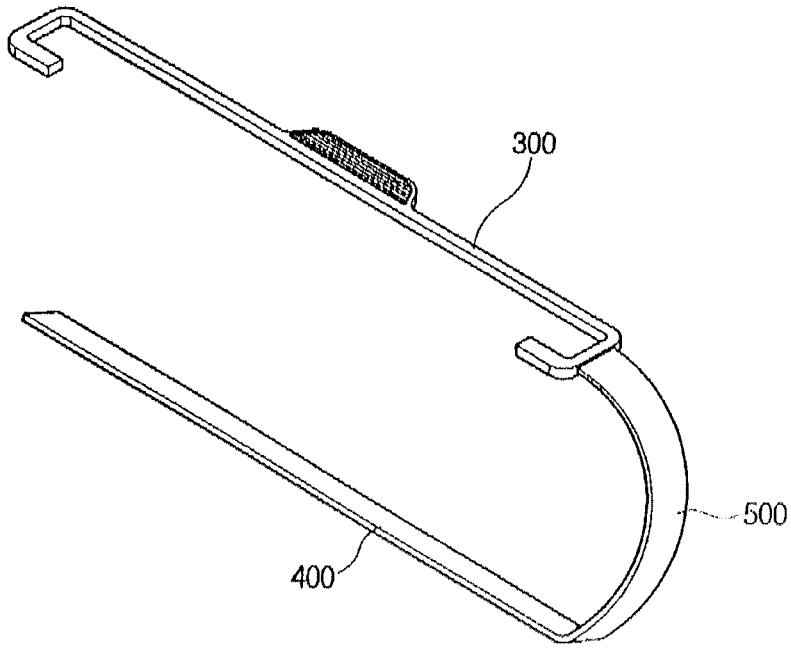
FIG. 4 is a perspective view illustrating a connecting part of the developing apparatus of FIG. 3.

FIGS. 3 and 4 illustrate a developing apparatus according to an embodiment of the present general inventive concept. Referring to FIGS. 3 and 4, the developing apparatus comprises an OPC frame part 100 to support an organic photo conductor (OPC) (not shown), and a developing roller frame part 200 to support a developing roller (not shown). The OPC frame part 100 is rotatably connected with the developing roller frame part 200 by a hinge part 150.

The developing apparatus further comprises a developer storing part (not shown) to store a developer, and provided with a supplying opening (not shown) through which the developer is supplied to the developing roller (not shown).

Figure 5:
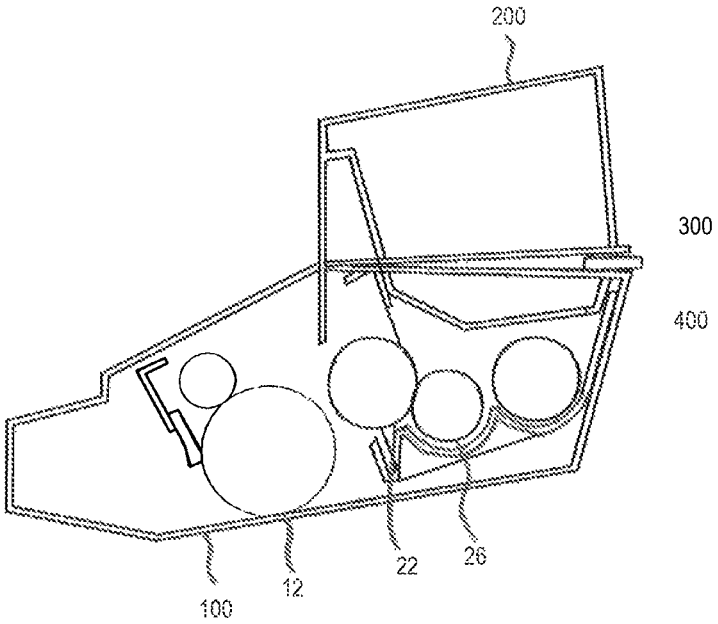
FIG. 5 illustrates a separation between the OPC drum and the developing roller by the spacer in the developing apparatus of FIG. 3.

A spacer 300 is removably interposed between the OPC frame part 100 and the developing roller frame part 200, and widens a space therebetween such that the organic photo conductor (not shown) does not contact the developing roller (not shown). The lack of contact between the organic photoconductor 12 and the developing roller 22 due to interposing the spacer therebetween is illustrated in FIG. 5.

The spacer 300, in a state in which the developing apparatus is not yet mounted on a main assembly of an electrophotographic image forming device, such as an electrophotographic printing device, prevents the organic photo conductor (not shown) from contacting the developing roller (not shown), thereby precluding damage to a surface of the organic photo conductor. In order to use the developing apparatus, the spacer 300 should be removed from the developing apparatus before the developing apparatus is mounted on the main assembly of the electrophotographic image forming device.

The spacer 300 is formed to be visible and exposed externally of the developing apparatus such that a user can recognize the spacer 300 and remove the spacer 300.

The spacer 300 may be interposed anywhere between the OPC frame part 100 and the developing roller frame part 200, as long as it creates a gap between the organic photo conductor (not shown) and the developing roller (not shown). Further, besides a hook shape, as shown in FIGS. 3 and 4, the spacer 300 may be formed in any shape as long as it separates the OPC frame part 100 and the developing roller frame part 200.

A leakage preventer 400 is removably attached to the supplying opening (not shown). The leakage preventer 400 seals the supplying opening, thereby preventing the developer from leaking out of the developer storing part (not shown).

The leakage preventer 400, in the state in which the developing apparatus is not yet mounted on the main assembly of the electrophotographic image forming device, prevents the developer from leaking out of the developer storing part (not shown). The leakage preventer 400 should be removed from the supplying opening (not shown) before the developing apparatus is mounted on the main assembly of the electrophotographic image forming device for use. When the leakage preventer 400 is removed from the developing apparatus, the developer may be supplied to the developing roller (not shown) through the supplying opening (not shown).

The leakage preventer 400 is provided to be visible and exposed externally of the developing apparatus such that a user can recognize the leakage preventer 400 and remove the leakage preventer 400 when the developing apparatus is mounted on the main assembly of the electrophotographic image forming device.

A connecting part 500 connects the spacer 300 with the leakage preventer 400. The connecting part 500 may be made of a flexible material. The spacer 300, the leakage preventer 400, and the connecting part 500 can be integrally formed.

The connecting part 500 is formed of a material strong enough that the user may remove both the spacer 300 and leakage preventer 400 from the developing apparatus by pulling either one of the spacer 300 and the leakage preventer 400.

Further, the connecting part 500 is provided to be visible and exposed externally of the developing apparatus such that a user can recognize the connecting part 500 and use the connecting part 500 to remove the spacer 300 and the leakage preventer 400 simultaneously, before the developing apparatus is mounted on the main assembly of the electrophotographic image forming device.

The user may remove both the spacer 300 and the leakage preventer 400 from the developing apparatus without difficulty by pulling the connecting part 500. The connecting part 500 may also be employed to hold the developing apparatus. The connecting part 500 may be provided as a handle.

At least one of the spacer 300, the leakage preventer 400, and the connecting part 500 may comprise a stopper to prevent the user from mounting the developing apparatus on the main assembly of the electrophotographic image forming device without removing the spacer 300 and the leakage preventer 400 from the developing apparatus. The stopper may be formed in any position where the developing apparatus contacts the main assembly of the electrophotographic image forming device when being mounted thereon. The stopper may be formed in any shape as long as the user can recognize that the developing apparatus is mounted incorrectly when mounting the developing apparatus on the main assembly of the electrophotographic image forming device without removing the spacer 300 and the leakage preventer 400.

The spacer 300, as illustrated in FIGS. 3 and 4, is exposed externally to be accessible, but the spacer 300 may not be exposed externally, as long as the spacer 300 is interposed between the OPC frame part 100 and the developing roller frame part 200 and creates a distance therebetween such that the OPC does not contact the developing roller. The user may remove the spacer 300 indirectly by pulling either the connecting part 500 or the leakage preventer 400 that is connected thereto as an alternative to removing the spacer 300 directly.

The OPC frame part 100, as illustrated in FIG. 3, is rotatably coupled with the developing roller frame part 200 by the hinge part 150, but the present general inventive concept is not limited there. The OPC frame part 100 may be coupled with the developing roller frame part 200 in a different manner, such as, for example, fixedly coupled therewith, etc. Any type of the connection is sufficient as long as the spacer 300 creates a distance between the OPC frame part 100 and the developing roller frame part 200 so as to separate the organic photo conductor and the developing roller.

An electrophotographic image forming device to which the developing apparatus, according to the present general inventive concept, applies may comprise a printer, a photocopier, a facsimile, a multi-function device, etc. The developing apparatus according to the present general inventive concept may apply to both a wet type electrophotographic image forming device for which the developer is liquid and a dry type electrophotographic image forming device for which the developer is powdery.

Further, the developing apparatus according to the present general inventive concept may apply to both a contact type electrophotographic image forming device in which an organic photo conductor and a developing roller contact each other during a developing process and a non-contact type electrophotographic image forming device in which an organic photo conductor and a developing roller are separated by a predetermined distance during a developing process.

Furthermore, the developing apparatus according to the present general inventive concept, may apply to both a black and white electrophotographic image forming device and a color electrophotographic image forming device.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing apparatus comprising:

a photoconductor;

a photoconductor frame part to support the photoconductor;

a developing roller to develop a latent image formed on the photoconductor by supplying a developer;

a developing roller frame part to support the developing roller, wherein the developing roller frame part is rotatably coupled to the photoconductor frame part via a hinge part;

a developer storing part to store the developer and provided with a supplying opening through which the developer is supplied to the developing roller;

a leakage preventer removably attached to and sealing the supplying opening;

an insertion opening defined by a portion of the photoconductor frame part and a portion of the developing roller frame part;

a spacer removably inserted in the insertion opening to maintain the photoconductor and the developing roller in a non-operational separated state; and a connection part to connect the spacer with the leakage preventer, wherein the insertion opening is configured to change in size according to rotation of the hinge part corresponding to insertion or removal of the spacer, and wherein the insertion opening is disposed in a first plane, and the supplying opening is disposed in a second plane.

2. The developing apparatus of claim 1, wherein the insertion opening decreases in size from a larger size, when the spacer is inserted in the insertion opening, to a smaller size, when the spacer is removed from the insertion opening.

3. The developing apparatus of claim 1, wherein the insertion opening for accommodating a complete insertion of the spacer is formed when the photoconductor and the developing roller are in the non-operational separated state.

4. The developing apparatus of claim 3, wherein the insertion opening is located nonadjacent to the developing roller and the photoconductor.

5. The developing apparatus of claim 1, wherein the spacer is first removed from the insertion opening and the leakage preventer is then removed from the supplying opening after the non-operational separated state is changed to an operational state.

6. The developing apparatus of claim 1, wherein the insertion opening comprises a first insertion opening and a second insertion opening located opposite sides of the developing apparatus.

7. The developing apparatus of claim 1, wherein at least one of the spacer and the leakage preventer serves as a stopper to prevent a user from mounting the developing apparatus in a main assembly of an image forming apparatus without removing the stopper from the developing apparatus.

8. The developing apparatus of claim 1, wherein the spacer is configured to contact with the portion of the photoconductor frame part and the portion of the developing roller frame part which define the insertion opening in the non-operational separated state.

* * * * *